US006241164B1

(12) United States Patent
Wolfe

(10) Patent No.: US 6,241,164 B1
(45) Date of Patent: Jun. 5, 2001

(54) EFFERVESCENT LIQUID FINE MIST APPARATUS AND METHOD

(75) Inventor: Joseph E. Wolfe, Richboro, PA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/651,940

(22) Filed: Aug. 31, 2000

(51) Int. Cl.[7] ..... A62C 13/66; B05B 9/03

(52) U.S. Cl. ..... 239/303; 239/302; 239/310; 239/316; 239/372; 239/373; 239/375; 169/27; 169/30; 169/71; 169/78; 169/85; 169/88; 169/89

(58) Field of Search ..... 169/21, 26, 27, 169/30, 71, 76, 77, 78, 85, 88, 89; 239/302, 303, 304, 310, 316, 337, 372, 373, 375, 389

(56) References Cited

U.S. PATENT DOCUMENTS 903,527 * 11/1908 Wilbur ..... 169/78
2,695,236 * 11/1954 Barton ..... 169/78 X
3,507,624 * 4/1970 Schneider, Jr. et al. ..... 239/310 X
3,741,310 * 6/1973 Hansen ..... 169/89
3,861,474 * 1/1975 De Palma ..... 169/88

* cited by examiner

*Primary Examiner*—David A. Scherbel
*Assistant Examiner*—Robin O. Evans
(74) *Attorney, Agent, or Firm*—Ron Billi

(57) ABSTRACT

An apparatus for creating a fine liquid mist includes a container capable of holding fluid; one of a perforated basket and a porous bag disposed in the container; a liquid supply connector connected to the container; a mixing chamber connected to the container; and at least one convergent/divergent nozzle connected to the mixing chamber. A method of forming an effervescent fine liquid mist includes mixing liquid and chemical reactant to form non-toxic, noncombustible gas bubbles; mixing the liquid and the gas bubbles to form a two-phase fluid flow; and directing the two-phase fluid flow through at least one convergent/divergent nozzle.

10 Claims, 5 Drawing Sheets

EFFERVESCENT LIQUID FINE MIST APPARATUS AND METHOD

STATEMENT OF GOVERNMENT INTEREST

The invention described herein may be manufactured and used by or for the Government of the United States of America for government purposes without the payment of any royalties therefor.

BACKGROUND OF THE INVENTION

The invention relates in general to fine liquid mist fire protection/suppression systems for fire extinguishment. In particular, the invention relates to an effervescent fine liquid mist-type system that uses chemical reactions to produce a bubbly two-phase flow output through a nozzle or array of nozzles.

Fluorocarbon-based fire extinguishants are environmentally harmful because they cause depletion of the earth's ozone layer. Present U.S. law and treaty requires the phase out and replacement of such materials under the 1988 Montreal Protocol, which classified Halon as a Class I Ozone Depleting Substance (ODS), and which called for limits on global production by over 100 developed nation signatories. Furthermore, the U.S. Clean Air Act Amendments of 1990 call for the ban on production of Halon in the U.S after January 1994. This law also prohibits purposeful venting and requires training personnel involved with their use to minimize their emission into the atmosphere. The U.S. Navy has responded to the requirements of these acts by prospectively prohibiting the use of ODSs and by finding and using alternative designs in fire extinguishment systems. Therefore, a need exists to replace all halon systems and improve existing water sprinkler based systems for more effective fire extinguishment use.

Fine liquid mist type systems have very favorable characteristics as a replacement for existing Halon systems. Typically, such systems include nozzles for creating misting fluids using a pressurized gas and such type systems are well-known. A liquid is injected into a central bore of a nozzle that directs a high-velocity gas. In some nozzles, the velocity and pressure of the gas are increased in a narrowed throat area of the bore, which causes atomization of the fluid into small droplets as the gas travels through the nozzle. To aid atomization and provide an unobstructed flow path for the gas, the fluid is usually injected into the gas stream through an aperture in the bore wall so that the two different fluid streams impinge at a 90-degree angle. Nozzles of the above-described type require high-pressure spraying of the liquid and the gas, which is undesirable. Another problem with these mixing nozzles is that the liquid and gas must be sprayed through fine holes of a small diameter, which can easily clog or wear away.

The use of water as a spray for fire extinguishment is well-known. Liquid-only, water spray nozzles for fire extinguishment create water droplets by deflecting the water flow just ahead of the spouting aperture. The droplet's size is relatively large and a desirable fine water mist cannot be achieved. The need for a low-pressure, reliable, liquid/gas mixing nozzle which is effective for fire extinguishment is disclosed in U.S. Pat. No. 5,520,331 issued on May 28, 1996 to Joseph E. Wolfe and entitled "Liquid Atomizing Nozzle", which patent is hereby expressly incorporated by reference. In the '331 patent, the nozzle structure effects an extremely fine, liquid atomization with low pressurization of the liquid and gas that are delivered to the nozzle. Furthermore, the fluid and gas are delivered through relatively large apertures so that wear and clogging are minimized. The '331 patent also discloses a convergent/divergent (C-D) gas nozzle affixed to a mixing block having a liquid delivery tube with an aperture that is centered within a gas conduit and located just upstream of a narrowed throat of the nozzle.

SUMMARY OF THE INVENTION

One aspect of the invention is an apparatus comprising a container capable of holding fluid; one of a perforated basket and a porous bag disposed in the container; a liquid supply connector connected to the container; a mixing chamber connected to the container; and at least one convergent/divergent nozzle connected to the mixing chamber. The apparatus further comprises a chemical reactant disposed in one of the perforated basket and the porous bag.

Another aspect of the invention is a method of forming an effervescent fine liquid mist comprising mixing liquid and chemical reactant to form non-toxic, noncombustible gas bubbles; mixing the liquid and the gas bubbles to form a two-phase fluid flow; and directing the two-phase fluid flow through at least one convergent/divergent nozzle. Preferably, the directing step includes directing the two-phase fluid through a plurality of convergent/divergent nozzles.

The method further comprises, after the directing step, expanding the gas bubbles in a diverging section of the nozzle. The method further comprises, after the expanding step, shearing the liquid to form a liquid mist.

Another aspect of the invention is an apparatus comprising a first container, the first container including pressurized liquid disposed therein; a second container disposed in the first container, the second container including a chemical reactant disposed therein, the second container including a gate having a closed position for isolating the pressurized liquid from the chemical reactant and an open position for allowing the pressurized liquid to enter the second container; a mechanism for opening and closing the gate in the second container; a mixing chamber connected to the second container; and at least one convergent/divergent nozzle connected to the mixing chamber.

Further objects, features and advantages of the invention will become apparent from the following detailed description taken in conjunction with the following drawing.

BRIEF DESCRIPTION OF THE DRAWING

Throughout the Figures, reference numerals that are the same refer to the same features.

DETAILED DESCRIPTION OF THE PREFERRED EMBODIMENTS

The invention includes a fine liquid mist fire protection/suppression system using an effervescent fine liquid mist device that effectuates a chemical reaction (with the liquid and a chemical reactant) to produce a bubbly two-phase extinguishment fluid flow that egresses through a converging-diverging (C-D) nozzle. The bubbly two-phase fluid flow or "effervescent flow" contains a non-toxic, noncombustible gas produced by the chemical reaction. The non-toxic, noncombustible gas provides the energy to atomize the liquid in a C-D nozzle.

Upon activation (automatically or manually) of the system, liquid flows into a chemical reactant-mixing chamber. The chemical reactant and the flowing liquid produce non-toxic, noncombustible gas bubbles. The liquid and bubbles flow together in a two-phase fluid flow region. The gas bubbles and liquid mix within a small region as they approach the C-D nozzle (a single nozzle or nozzle array). Next, the liquid flows through the throat section with the highly compressed gas bubbles. After passing through the throat section and into the diverging section of the C-D nozzle, the gas rapidly expands with an increase in velocity. The energy from this rapid expansion of the gas shears the liquid causing the liquid to shatter (explode) into small droplets (mist). For effervescent atomization, a bubbly two-phase flow in the mixing chamber is required.

The C-D nozzle(s) generates optimal fine liquid mist atomization of an extinguishant agent. The C-D nozzle imparts superior performance because of increased momentum of the "effervescent flow" due to compression of the gas bubbles, increased velocity of the flow and rapid expansion of the gas bubbles by the C-D nozzle downstream of the throat. Mixing and atomization of effervescent liquid into a fine liquid mist is a more desirable and efficient state of the liquid for fire protection applications because it results in greater surface area coverage and has high latent heat of vaporization characteristics.

Mechanisms of fire extinguishment using a fine liquid mist are air/gas cooling, wetting of hot surfaces, the rapid expansion of vapor leading to the depletion of oxygen, and smothering the flame. The very small liquid droplet size and high momentum induced by the nozzle allows for deeper and more effective flame penetration and expansion of the liquid into vapor more quickly, thus providing a very effective fire extinguishment system.

Figure 1:
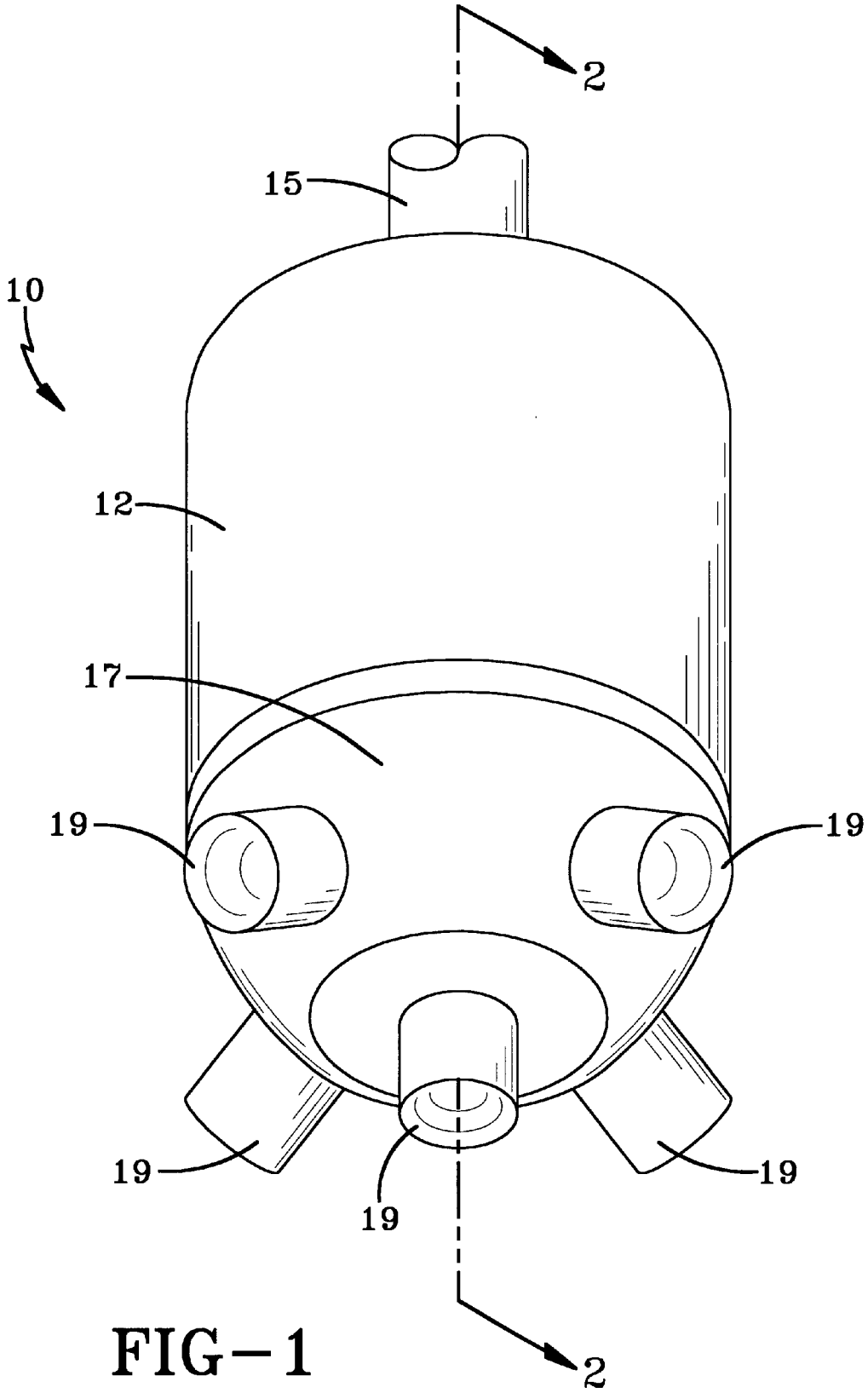
FIG. 1 is a perspective view of one embodiment of the invention.
Figure 2:
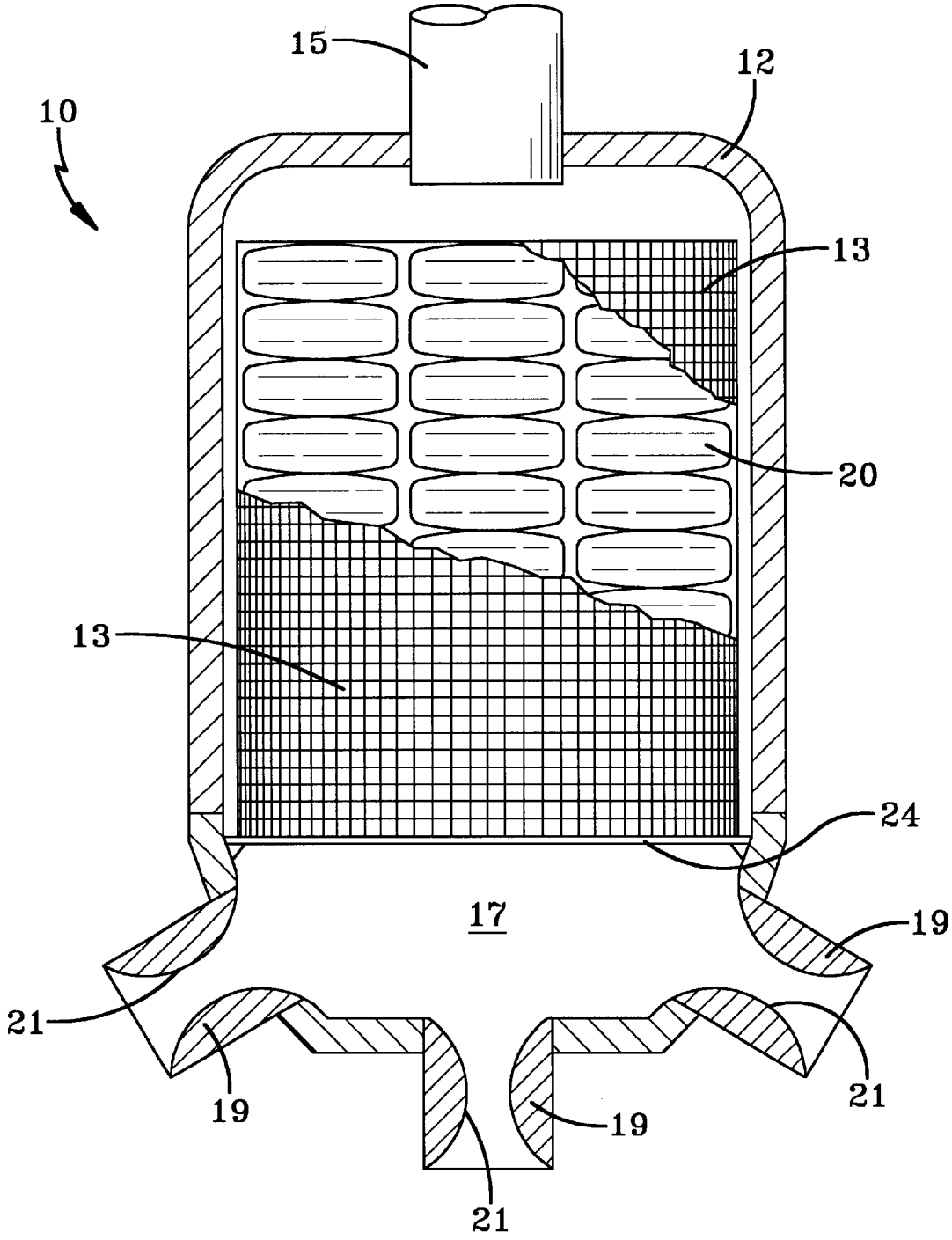
FIG. 2 is a sectional view along the line 2—2 of FIG. 1.
Figure 2A:
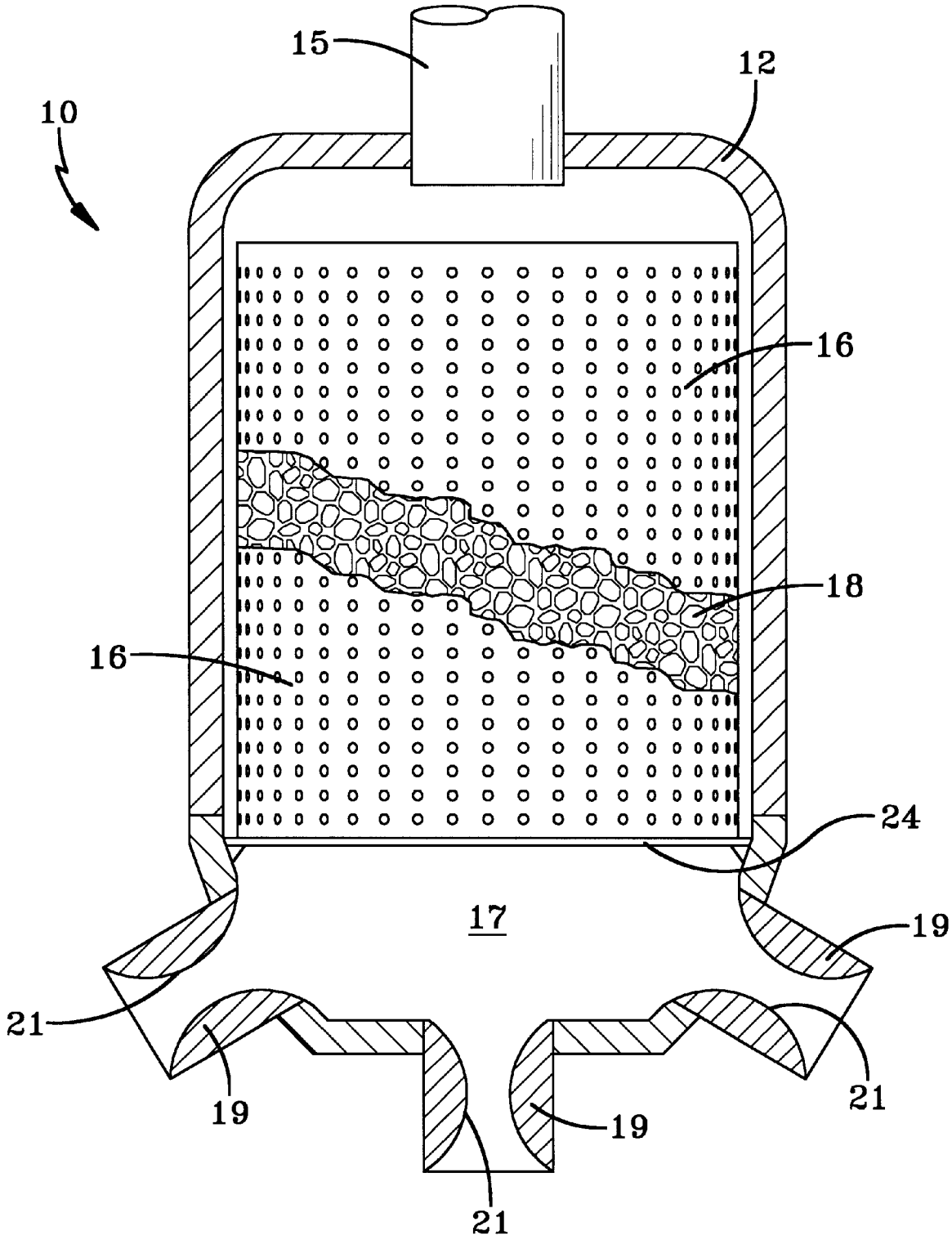
FIG. 2A is a sectional view along the line 2—2 of FIG. 1 showing a variation of the embodiment of FIG. 2.

FIG. 1 is a perspective view of one embodiment of the invention. FIG. 2 is a sectional view along the line 2—2 of FIG. 1. FIG. 2A is a sectional view along the line 2—2 of FIG. 1 showing a variation of the embodiment of FIG. 2.

In the embodiment of FIGS. 1 and 2, an effervescent fine liquid misting or fire extinguishing apparatus 10 is part of a continuous liquid feed system. The apparatus 10 includes a container 12 capable of holding fluid, a perforated basket 13 disposed in the container 12, a liquid supply connector 15 connected to the container 12, a mixing chamber 17 connected to the container 12 and at least one convergent/divergent nozzle 19 connected to the mixing chamber 17. In the embodiment of FIGS. 1 and 2, five convergent/divergent nozzles 19 are used. The perforated basket 13 is preferably made of a screen material. A piece of screen-like material 24 may be disposed upstream from the mixing chamber 17 to prevent chemical reactant from entering mixing chamber 17.

A chemical reactant 20 is disposed in the perforated basket 13. The liquid supply connector 15 is connected to a liquid supply (not shown). The liquid and chemical reactant 20 are chosen so that when mixed, the liquid and chemical reactant 20 form non-toxic, noncombustible gas bubbles. The liquid should also possess fire retardant properties. In a preferred embodiment, the liquid is water, the chemical reactant 20 is heat treated sodium bicarbonate tablets and the gas bubbles created are carbon dioxide. In the embodiment shown in FIG. 2A, a porous bag 16 is used rather than the perforated basket 13. The chemical reactant in the porous bag 16 is preferably sodium bicarbonate granules 18. Those of skill in the art will understand that other combinations of liquids and chemical reactants may be used.

When the apparatus 10 is activated automatically or manually by well know implements and methods, liquid flows into the perforated basket 13. The chemical reactant 20 and the flowing liquid produce non-toxic, noncombustible gas "bubbles". The liquid and bubbles subsequently flow together through the basket 13. The gas bubbles and liquid mix for a short distance in the mixing chamber 17 as they approach the C-D nozzles 19. The bubbly two-phase flow or "effervescent flow" contains non-toxic, noncombustible gas produced by the chemical reaction between the liquid and the chemical reactant 20.

The gas bubbles supply the energy to atomize the liquid in each of the C-D nozzles 19. The liquid, which is incompressible, flows through the throat section 21 of the nozzles 19 with the now highly compressed gas bubbles. Downstream of the throat section 21, in the diverging section of the C-D nozzle, the gas rapidly expands and its velocity increases. The energy from this rapid expansion of the gas shears the liquid causing the liquid to "shatter or explode" into small droplets (mist). In the continuous water feed-type system as shown in FIGS. 1 and 2, there is no need for a pressurizing gas. The liquid pressure (upon activation) is sufficient to start the process. Typically, the liquid supply may be operated at about 15 psi. This is a significant operational advantage over the prior art, because low operational pressures are preferable when charged and ready to operate.

Figure 3:
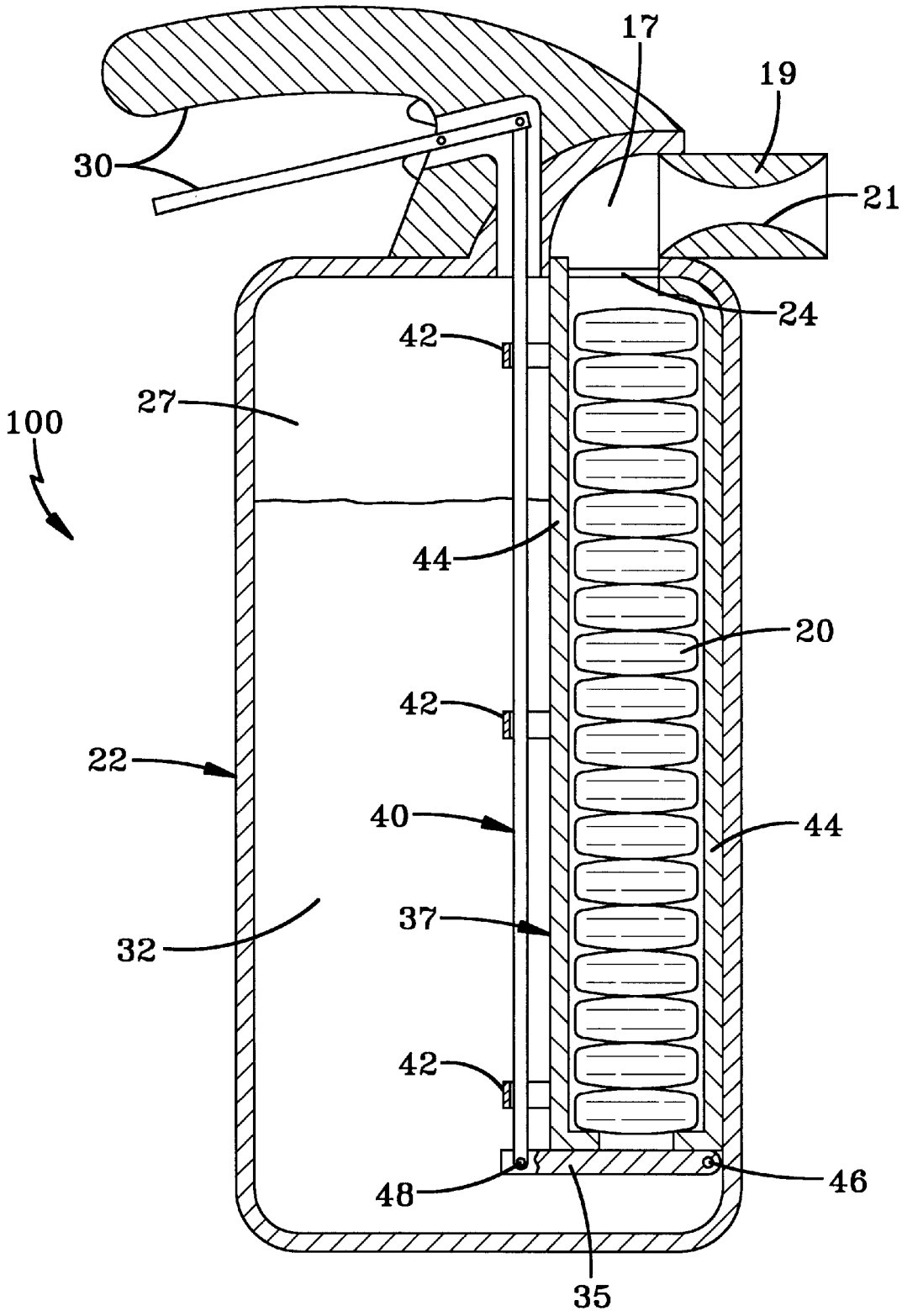
FIG. 3 is a sectional view of another embodiment of the invention.
Figure 4:
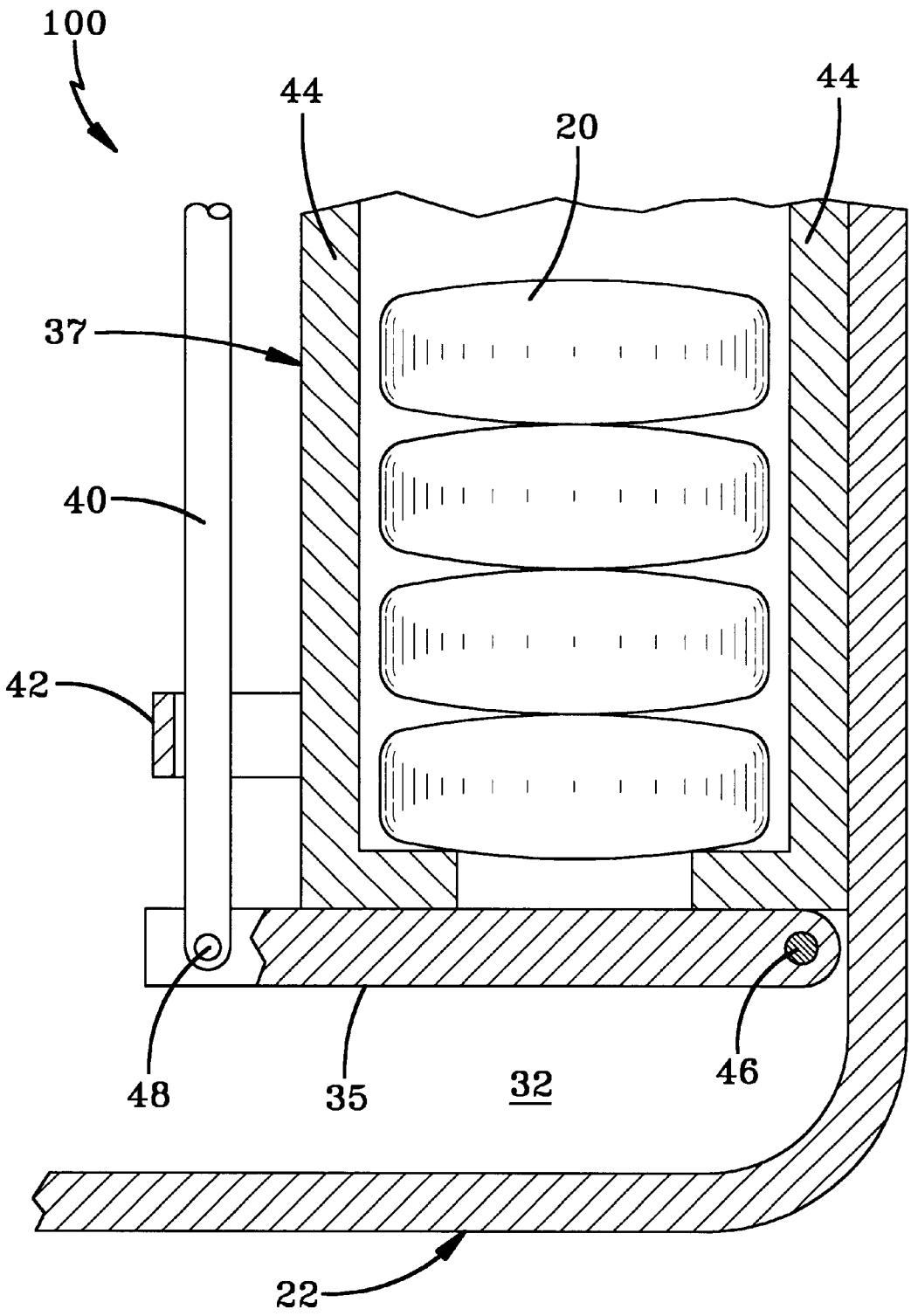
FIG. 4 is an enlarged view, partially in section, of the gate portion of the embodiment of FIG. 3.

FIG. 3 is a sectional view of another embodiment of the invention. FIG. 4 is an enlarged view, partially in section, of the gate portion of the embodiment of FIG. 3. In FIG. 3, the invention is embodied as a self-contained pressurized canister fire extinguishing apparatus 100. The apparatus 100 includes a first container 22 including a pressurized liquid 32 disposed therein and a second container 37 including a chemical reactant 20 disposed therein. The second container 37 is disposed in the first container 22.

The second container 37 includes a gate 35 having a closed position (as shown in FIGS. 3 and 4) for isolating the pressurized liquid 32 from the chemical reactant 20 and an open position for allowing the pressurized liquid 32 to enter the second container 37. A mechanism for opening and closing the gate 35 includes grip handles 30, a rod 40 connected at one end to one of the grip handles 30 and connected at the other end to the gate 35, and a plurality of retainer rings 42. The retainer rings 42 are attached to the wall 44 of the second container 37. The retainer rings 42 have openings therethrough that allow the rod 40 to move up and down. Gate 35 is pivotally attached at one end 46 to the wall 44 of the second container 37, and pivotally attached at the other end 48 to the end of rod 40. Gate 35 is maintained in the closed position by pressure from the pressurized liquid 32. Preferably, gate 35 is a gasket flapper similar to those used in water closets.

Apparatus 100 further comprises a mixing chamber 17 connected to the second container 37 and at least one convergent/divergent nozzle 19 connected to the mixing chamber 17. A piece of screen-like material 24 may be disposed between the second container 37 and the mixing chamber 17 to prevent chemical reactant from entering mixing chamber 17. One nozzle 19 is shown in FIG. 3, however, more than one nozzle 19 may be used. A pressurizing gas 27 is disposed in the first container 22 for pressurizing the liquid 32. The liquid 32 and chemical reactant

20 are chosen as discussed above with reference to FIGS. 1 and 2. Preferably, the liquid 32 is water and the chemical reactant 20 is heat treated sodium bicarbonate tablets. Alternatively, a porous bag 16 containing sodium bicarbonate granules 18 (as shown in FIG. 2A) may be substituted for the heat treated sodium bicarbonate tablets.

The apparatus 100 uses pressurizing gas 27 such as air or nitrogen that is stored at approximately 30 psi. The bubble formation region of the second container 37 contains the chemical reactant 20. The apparatus 100 is activated when grip handles 30 are pressed together. Rod 40 moves downward through retaining rings 42 and forces end 48 of gate 35 to rotate downwardly around pivoting end 46. Liquid 32 flows through gate 35 into second container 37. In second container 37, liquid 32 reacts with chemical reactant 20 producing gas bubbles and an "effervescent flow" towards mixing chamber 17. The two-phase effervescent flow atomizes and creates a high velocity mist after flowing through the nozzle 19.

There are many applications for the invention, including, but not limited to: a) portable fire extinguishers, b) small compartment fire protection such as cable plenums, dry bays, flammable container closets, c) sprinkler head replacement so as to reduce water consumption, d) halon bottle replacement for various applications, e) fire suppression systems within aircraft cabins and storage bays and f) use in building sprinkler systems.

Other applications include medical devices such as a nebulizer where a fme liquid mist is required and agricultural devices for applying chemicals to plant life. In general, the invention is useful in applications where there is limited space, weight, and/or cost. It should be understood by those of ordinary skill in the art that the apparatus as shown in the preferred embodiments may be made of individual sections or may be a unitary molded part.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus, comprising:

a first container, the first container including pressurized liquid disposed therein;

a second container disposed in the first container, the second container including a chemical reactant disposed therein, the second container including a gate having a closed position for isolating the pressurized liquid from the chemical reactant and an open position for allowing the pressurized liquid to enter the second container;

a mechanism for opening and closing the gate in the second container;

a mixing chamber connected to the second container; and at least one convergent/divergent nozzle connected to the mixing chamber.

2. The apparatus of claim 1 further comprising a pressurizing gas disposed in the first container, for pressurizing the pressurized liquid.

3. The apparatus of claim 2 wherein liquid is water and the chemical reactant comprises sodium bicarbonate.

4. The apparatus of claim 3 wherein the sodium bicarbonate is in the form of heat treated tablets.

5. The apparatus of claim 1 wherein the at least one convergent/divergent nozzle comprises a plurality of convergent/divergent nozzles.

6. The apparatus of claim 1 wherein the gate comprises a gasket flapper pivotally attached to a all of the second container.

7. The apparatus of claim 6 wherein the gate is maintained in the closed position by pressure from the pressurized liquid in the first container.

8. The apparatus of claim 7 wherein the mechanism for opening and closing the gate in the second container includes grip handles, a rod connected at one end to one of the grip handles and connected at another end to the gate.

9. The apparatus of claim 3 further comprising a porous bag disposed in the second container, the sodium bicarbonate being in the form of granules disposed in the porous bag.

10. The apparatus of claim 1 further comprising a piece of screen-like material disposed between the second container and the mixing chamber.

* * * * *